US008943767B2

(12) United States Patent
Lewis

(10) Patent No.: US 8,943,767 B2
(45) Date of Patent: Feb. 3, 2015

(54) COVER DEVICE AND COVER DEVICE KIT

(71) Applicant: David L. Lewis, Bethlehem, CT (US)

(72) Inventor: David L. Lewis, Bethlehem, CT (US)

( * ) Notice: Subject to any disclaimer, the term of this patent is extended or adjusted under 35 U.S.C. 154(b) by 0 days.

(21) Appl. No.: 13/793,778

(22) Filed: Mar. 11, 2013

(65) Prior Publication Data

US 2014/0250805 A1 Sep. 11, 2014

(51) Int. Cl.
*E04D 13/03* (2006.01)
*E06B 3/267* (2006.01)
*E04B 1/80* (2006.01)

(52) U.S. Cl.
CPC ..... *E04B 1/80* (2013.01); *E04D 13/0335* (2013.01)
USPC ..... 52/200; 52/20; 52/202

(58) Field of Classification Search
USPC ..... 52/19, 20, 200, 202, 590.1
See application file for complete search history.

(56) References Cited

U.S. PATENT DOCUMENTS

| | | | | |
|---|---|---|---|---|
| 4,281,743 | A * | 8/1981 | Fuller | 182/46 |
| 5,018,333 | A * | 5/1991 | Bruhm | 52/741.4 |
| 5,687,514 | A * | 11/1997 | Gillispie | 52/58 |
| 6,223,490 | B1 | 5/2001 | Wessley et al. | |
| 7,690,165 | B2 | 4/2010 | Taylor | |
| 7,712,279 | B2 * | 5/2010 | McClure | 52/580 |
| 2004/0055819 | A1 | 3/2004 | Lynn et al. | |
| 2007/0095608 | A1 * | 5/2007 | Taylor | 182/78 |
| 2010/0132279 | A1 * | 6/2010 | Valentz | 52/200 |
| 2010/0139186 | A1 * | 6/2010 | Laremore | 52/200 |
| 2011/0265392 | A1 | 11/2011 | Uhl et al. | |
| 2012/0044705 | A1 * | 2/2012 | Holder et al. | 362/365 |
| 2012/0186179 | A1 | 7/2012 | Melesky | |

OTHER PUBLICATIONS

Design Research & Development Corporation, "Insulated Attic Stair Access Cover," downloaded from the Internet Nov. 30, 2012 (http://www.drdcorp.com/attic-ladder-cover.htm), 3 pages.
New York Building Technology (NYBT) Group, "Attic Scuttle Hatch," downloaded from the Internet Nov. 30, 2012 (http://www.nybtg.com/downloads/Attic_Scuttle.pdf), 1 page.
Battic Door, "E-Z Hatch Attic Access Scuttle Door," downloaded from the Internet Nov. 30, 2012 (http://www.batticdoor.com/atticaccessdoor.html), 5 pages.
Battic Door, "The Battic © Door Attic Stairs Insulator Cover" downloaded from the Internet Nov. 30, 2012 (http://www.batticdoor.com/StairCoverSize.html), 3 pages.
Recessed Lighting Protection, TheraStop CanCap, downloaded from the Internet Nov. 30, 2012 (http://www.ThermaStop.com), 2 pages.

* cited by examiner

*Primary Examiner* — Joshua J Michener
*Assistant Examiner* — Kyle Walraed-Sullivan
(74) *Attorney, Agent, or Firm* — Ware, Fressola, Maguire & Barber LLP

(57) ABSTRACT

A cover device kit includes: a plurality of heat insulation components comprising a lightweight construction material such as synthetic resin foam capable of being transported in a disassembled state and then quickly assembled into a box-shaped heat barrier structure having six sides including an opening on an open side for covering an opening in a floor or wall of a building. Four of the plurality of heat insulation components 14, 16, 18, 20 each includes two complimentary connections for uniting with two corresponding adjacent heat insulation components of the plurality of heat insulation components when assembled into four side walls of the box-shaped heat barrier structure 10. The cover 12 serves as a fifth heat insulation component and unites with the four components 14, 16, 18, 20 that constitute side walls of the box-shaped structure and is situated opposite the opening on the open side.

16 Claims, 8 Drawing Sheets

COVER DEVICE AND COVER DEVICE KIT

BACKGROUND

Insulating covers, such as attic scuttle hatch covers, are made to provide a match with the R-value of the ceiling and to try to make an airtight seal. Such covers can for instance be made with several layers of foam board between two outer plywood boards so as to have enough weight to make a reasonably good seal on a weatherstrip perimeter. Assembly can be done on site using adhesive with pressure applied to the layers until dried. A weatherstrip can then be applied to the bottom of the frame so that its perimeter surrounds the scuttle hole. The same idea is applicable to covers made for a similar purpose of providing a heat barrier for a wall, floor, louver opening of a building with a heated space with warmth on one side and cold on the other. Other approaches are known for example from U.S. Pat. No. 6,224,490 to Wessley et al where a scuttle hole cover comprises a sleeve that extends into the attic and a locking mechanism to lock an insulating cover in place.

Another example made by DRD Corporation of Glenmoore, Pa., is a prefabricated insulated cover for drop down attic stairs with outside dimensions (one size fits all) of 38 inches (wide) by 63 inches (long) by 8.5 inches (high) and a weight of approximately 30 pounds and made of polyethylene closed cell foam in a thickness of nearly 5 inches with no assembly required and usable for openings up to 30 by 54 inches. Installation involves positioning the cover over the attic ladder access hole and screwing some pre-drilled strap hinges of the cover to the attic floor.

Lynn et al. (U.S. Pat. Application Publication No. 2004/0055819 A1) show a thermal insulating cover for use over attic stairs that is made from an insulating blanket cut and folded to form a box.

Uhl et al. (U.S. Pat. Application Publication No. 2011/0265392 A1) show in an application entitled "Energy efficient scuttle cover kits," an insulated scuttle cover that includes a scuttle panel configured to cover a building scuttle opening and further configured to be supported when positioned within the building scuttle opening. An insulative assembly is attached to the scuttle panel. The insulative assembly includes insulation material encapsulated by a jacket. The insulated scuttle cover is configured to prevent or substantially retard the flow of air passing through the building scuttle opening.

Melesky (U.S. Pat. Application Publication No. 2012/0186179) shows a cover for closing an access opening that leads to an infrequently used space within a building, such as an attic, that generally provides an air seal, thermal insulation and/or acoustic insulation at the access opening. The cover may be in one or two portions, including a closure alone or a closure and a frame having an aperture that can be closed by engagement between the closure and the frame. When the cover is used alone it engages a frame or a wall circumscribing the access opening. The cover is sized and shaped to close a stairwell, or the opening at one end of a stairway, an opening in a generally vertical wall, a hatch, or a pull down ladder. The closure and frame are each made of one or more components.

SUMMARY

According to a first aspect of the present invention, a cover device kit is provided that includes a plurality of heat insulation components made of a lightweight insulating material capable of being transported in a disassembled state and then assembled into a box-shaped heat barrier structure having six sides including an opening on an open side, the structure for covering an opening in a floor or wall of a building with the opening on the open side surrounding the opening in the floor or wall and resting on the floor or against the wall, wherein four of the plurality of heat insulation components each comprises two complimentary connections for uniting with two corresponding adjacent heat insulation components of the plurality of heat insulation components when assembled into four side walls of the box-shaped heat barrier structure, and wherein a fifth heat insulation component of the plurality of heat insulation components unites with the four side walls of the box-shaped structure opposite the opening on the open side.

In accordance with the first aspect of the present invention, each complimentary connection in each heat insulation component may include a dowel channel in a mating surface that is offset from a complementary dowel channel in a corresponding complimentary mating surface of the adjacent heat insulation component so that when a dowel is inserted to make the complimentary connection the mating surface and the complimentary mating surface are compressed together to remove the offset and form a resultant airtight seam.

In further accordance with the first aspect of the present invention, the heat insulation components are for blocking heat transfer through the opening in the floor of the building from a first area in the building to a second area in the building that is cooler than the first area or are for blocking heat transfer through the opening in the wall of the building from a first area inside the building to a second area inside or outside the building that is cooler than the first area.

In still further accordance with the first aspect of the present invention, the plurality of heat insulation components are of polymer material in panel form.

In accord with the first aspect of the present invention, each of the at least one complimentary connections is independently selected from the group consisting of a tongue and groove joint, a step joint, a dovetail joint, a box joint, a mortise and tenon joint, a dado joint, a dowel butt joint, a butt joint, a lap joint, a halving joint, hook and loop fasteners, and snap fasteners.

In further accord with the first aspect of the present invention, each of the at least one complimentary connections is independently selected from the group consisting of a tongue and groove joint, a step joint, and a butt joint.

In still further accord with the first aspect of the present invention, the plurality of components are flat panels that are packaged for transport and/or storage with the flat panels sized for being tightly stacked in a compact stack of flat panel layers so as to provide for economical and compact packaging that provides robustness against damage in the transport and/or storage.

Still in accordance with the first aspect of the present invention, the box-shaped heat barrier structure comprises a right-angled parallelepiped shaped configuration.

Still further in accordance with the first aspect of the present invention, the plurality of heat insulation components of the kit comprises:

a first pair of cover components, wherein each cover component of the first pair of cover components comprises a four-sided panel including a cover groove running along one edge of a first side of the panel and two slots in the first side running along opposite edges of the panel perpendicular to the cover groove, each slot including a parallel groove in a wall of the slot;

a second pair of cover components, wherein each cover component of the second pair of cover components comprises a four-sided panel including a cover groove running along one edge of a first side and two tongues in the first side running along opposite edges of the panel perpendicular to the cover groove, each tongue including a parallel groove in a wall of the tongue;

a cover panel; and four rods, wherein the cover device kit is capable of being transported in a disassembled state and then assembled when the first pair of cover components are united with the second pair of cover components so that each cover component of each pair is assembled opposite to the other cover component of the pair, by insertion of each tongue of the two tongues of each cover component of the second pair of cover components in a corresponding slot of the two slots of a cover component of the first pair of cover components, and with the cover panel inserted in the cover groove of each cover component of the first pair and in the cover groove of each cover component of the second pair, and wherein the four rods are inserted in the parallel grooves in each slot to form the at least one complimentary connection for uniting each of the cover components with another when assembled into the box-shaped heat barrier structure.

In further accord with he first aspect of the invention, the assembled device comprising a three-dimensional heat barrier structure comprises a box-shaped configuration with a closed top defined by the cover panel and an open bottom in the box-shaped heat barrier structure and the device is thereby capable of placement over a scuttle hole, attic access opening, louver opening, or an opening in a wall or floor.

Still in accordance with the first aspect of the present invention, the components are capable of being tightly stacked together forming a unit, wherein one or more units are capable of being economically transported and/or stored.

According to a second aspect of the present invention, a cover device includes:

a first pair of cover components, wherein each cover component of the first pair of cover components comprises a four-sided panel including a cover groove running along one edge of a first side of the panel and two side grooves in the first side running along opposite edges of the panel perpendicular to the cover groove, each side groove including a parallel dowel channel half in a wall of the side groove;

a second pair of cover components, wherein each cover component of the second pair of cover components comprises a four-sided panel including a cover groove running along one edge of a first side and two tongues in the first side running along opposite edges of the panel perpendicular to the cover groove, each tongue including a parallel dowel channel half in a wall of the tongue that is complementary to a parallel dowel channel half in a mating side groove of a corresponding cover component of the first pair of cover components;

a cover panel; and four dowel rods, wherein the device is capable of being transported in a disassembled state and then assembled when the first pair of cover components are united with the second pair of cover components so that each cover component of each pair is assembled with the first side opposite to the first side of the other cover component of that pair, by insertion of each tongue of the two tongues of each cover component of the second pair of cover components in a corresponding side groove of the two side grooves of a cover component of the first pair of cover components, and with the cover panel inserted and secured within the cover groove of each cover component of the first pair and within the cover groove of each cover component of the second pair, and wherein the four dowel rods are inserted in a whole dowel channel formed by the parallel dowel channel halves in each side groove to form the at least one complimentary connection for uniting each of the cover components with two others when assembled into the cover device.

In accordance with the second aspect of the present invention, each side groove comprises the dowel channel half in the wall such that it is offset from a complementary dowel channel half in a wall of an inserted tongue of the corresponding cover component so that when a dowel rod is inserted to make the complimentary connection, the wall of the tongue and the complimentary wall of the groove are compressed together to remove the offset and form a resultant airtight seam.

In further accord with the second aspect of the present invention, the assembled device comprises a box-shaped configuration capable of placement over a scuttle hole, attic access opening, louver opening, or an opening in a wall or floor.

In still further accord with the second aspect of the present invention, the components are capable of being tightly stacked together forming a unit, wherein one or more units are capable of being economically transported and/or stored.

Still further in accordance with the second aspect of the present invention, the components are flat panels that are packaged for transport and/or storage with the flat panels sized for being tightly stacked in a compact stack of flat panel layers so as to provide for economical and compact packaging that provides robustness against damage in the transport and/or storage.

These and other objects and advantages of the present invention will become apparent to those skilled in the art from the following detailed description read in conjunction with the attached drawings and claims appended hereto.

DETAILED DESCRIPTION

Figure 2:
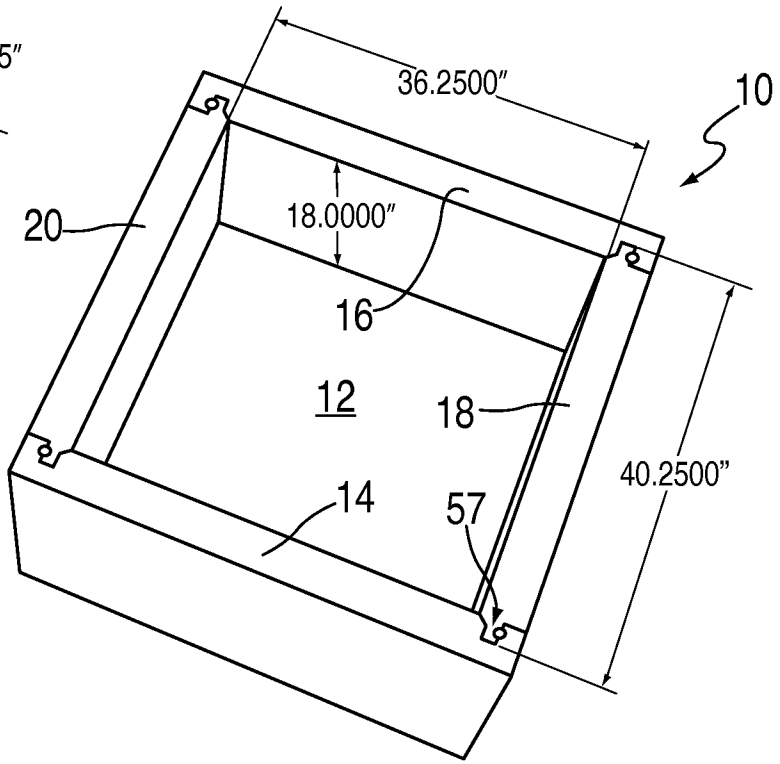
FIG. 2 shows a perspective view of the cover device of FIG. 1, as shown from a bottom view with the open side opening facing the viewer.
Figure 1:
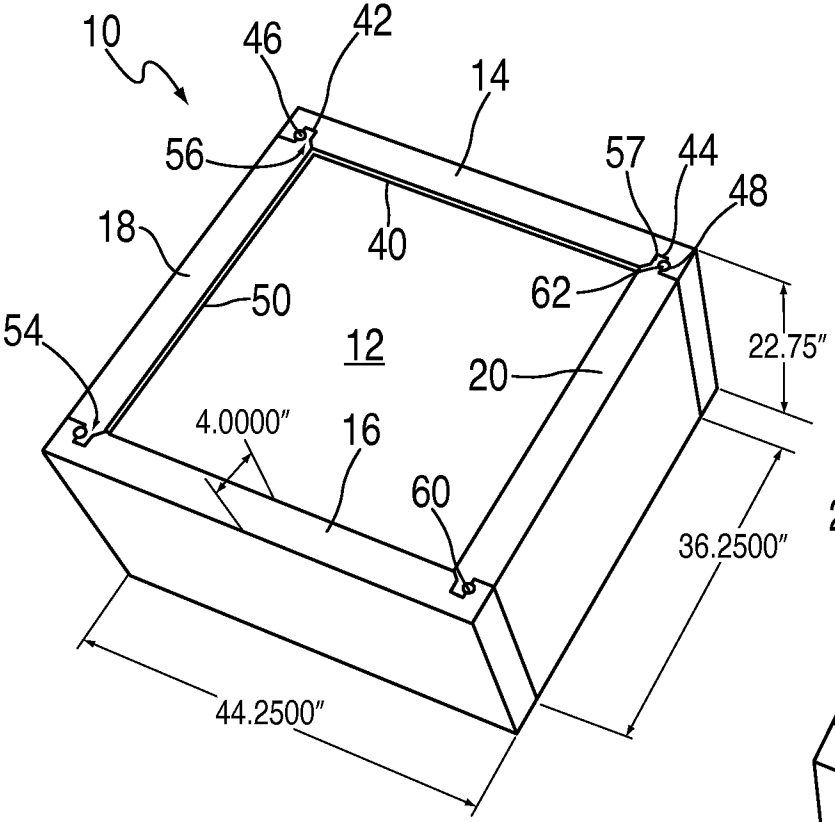
FIG. 1 shows a perspective view of a cover device, as shown from a top view with the bottom opening hidden, assembled from a cover device kit according to the present invention.

A cover device 10 made from a kit is shown in perspective (not to scale) in its fully assembled form from a cover-side view in FIG. 1 (with a cover 12 facing the viewer) and from an open-side view in FIG. 2 (with the open side closest to the viewer opposite the cover). Dimensions are shown by way of example only and not limitation. The dimensions will vary depending on the application. The assembled cover device includes: a plurality of heat insulation components comprising a lightweight construction material such as synthetic resin foam capable of being transported in a disassembled state and then quickly assembled into a box-shaped heat barrier structure having six sides including an opening on an open side as shown. The structure is for covering an opening in a floor or wall of a building with the opening on the open side surrounding the opening in the floor or wall and resting on the floor or against the wall. Four of the plurality of heat insulation components 14, 16, 18, 20 each includes two complimentary connections for uniting with two corresponding adjacent heat insulation components of the plurality of heat insulation components when assembled into four side walls of the box-shaped heat barrier structure 10. The above-mentioned cover 12 serves as a fifth heat insulation component of the plurality of heat insulation components and unites with the four components 14, 16, 18, 20 that constitute side walls of the box-shaped structure and is situated opposite the opening on said open side as already discussed above.

Figure 3:
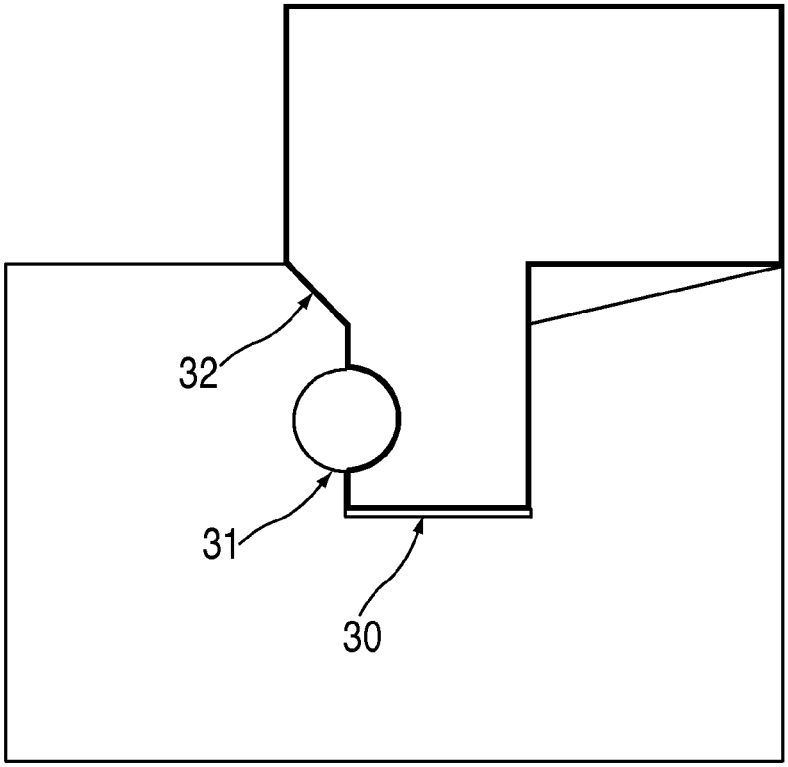
FIG. 3 shows an example of two components in the act of being connected, before the dowel is inserted in the dowel channel.

As shown in FIG. 3, a tongue complimentary connection of one component is shown in the act of being inserted from above in a groove complimentary connection of another component. The insertion is not quite completed though because the dowel has not yet been inserted and there is a small gap 30 between the end of the tongue and the bottom of the groove. As shown, in each complimentary connection of a given heat insulation component, there is provided a dowel channel half in a mating surface that upon initial insertion of the tongue, as shown, is offset 31 from a complementary dowel channel half in a corresponding complimentary mating surface of the adjacent heat insulation component. As a consequence, when a dowel is inserted in the full dowel channel to make the complimentary connection permanent, the mating surface and the complimentary mating surface are compressed together to remove the offset and form a resultant airtight seam. At that time the tongue is forced further into the groove and the gap 30 is closed so that the dowel channel in effect becomes circular without suffering from the previous gap with the discontinuities of the previous offset to the complimentary semi-circular dowel channel halves.

Upon assembly of the heat insulation components, the cover device 10 is formed and it is then usable for blocking heat transfer through an opening in a floor of a building from a first area in the building to a second area in the building that is cooler than the first area. Or it may be instead be used for blocking heat transfer through an opening in a wall of a building from a first area inside the building to a second area inside or outside the building that is cooler than the first area.

The plurality of heat insulation components may comprise any lightweight heat insulation material such as a synthetic resin foam material or a polymer material in panel form.

For the connection method, each of said at least one complimentary connections may independently be selected from the group consisting of a tongue and groove joint, a step joint, a dovetail joint, a box joint, a mortise and tenon joint, a dado joint, a dowel butt joint, a butt joint, a lap joint, a halving joint, hook and loop fasteners, and snap fasteners. Any of these should be understood as being means or structures capable of performing the described function of joining together the parts and not only structural equivalents, but also equivalent structures. Thus although a nail and a screw may not be structural equivalents in that a nail employs a cylindrical surface to secure wooden parts together, whereas a screw employs a helical surface, in the environment of fastening wooden parts, a nail and a screw may be equivalent structures.

As mentioned, the plurality of components is capable of being tightly stacked providing for economical packing for transport, storage, or both.

The box-shaped heat barrier structure is shown as a right-angled parallelepiped shaped configuration but may not be box-shaped. It could for instance utilize rounded walls in whole or in part to form a differently shaped barrier such as a cylindrical cap that uses the same kind of complimentary connections as described. A capsule shape is also envisioned with two flat side panels and two curved end caps with a flat or curved cover, depending on the application.

The plurality of heat insulation components of the cover device kit in disassembled form will include a first pair of cover components 14, 16, wherein each cover component of the first pair of cover components comprises a four-sided panel including a cover groove running along one edge of a first side of said panel (the top edge 40 of such a groove is shown in FIG. 1 running along and just below the top edge of the first (inner) side of component 14) and two grooves 42, 44 in this first (inner) side running along opposite edges of the panel perpendicular to the cover groove, each groove including a parallel dowel channel half 46, 48 in a wall of the slot.

Figure 4:
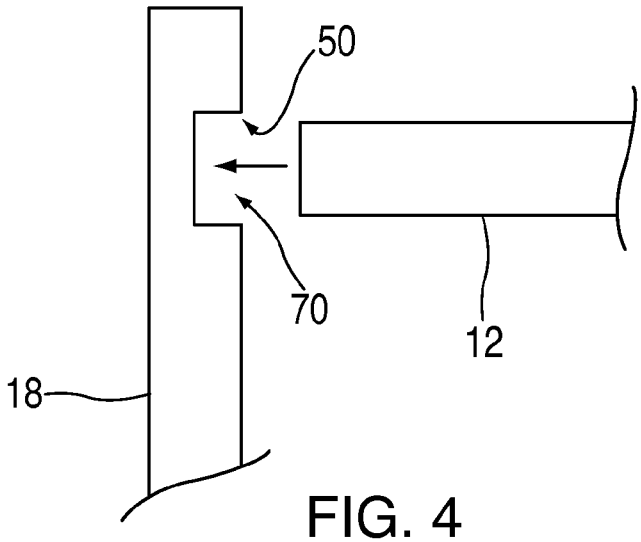
FIG. 4 shows the cover being inserted in a slot running perpendicular to the view shown in the Figure, along a top edge of the component into which the cover is being inserted.

A second pair of cover components 18, 20 each also being a four-sided panel including a cover groove 70 as shown for instance in FIG. 4 (and as indicated by a top edge 50 thereof in FIG. 1) running along one edge of a first (inner) side and two tongues 54, 56 in or near the first side running along opposite edges of the panel 18, 20 perpendicular to its cover groove, each tongue including a parallel dowel channel half 60, 62 in a wall of the tongue.

The cover panel 12 will also form a part of the kit in its packed form ready for storage or transport along with four dowel rods. The cover device kit is capable of being transported in a disassembled state and then assembled when the first pair of cover components 14, 16 are united with the second pair of cover components 18, 20 so that each cover component of each pair is assembled opposite to the other cover component of the pair. This is accomplished by insertion of each tongue of the two tongues of each cover component of the second pair of cover components in a corresponding groove of the two grooves of the cover component of the first pair of cover components, and with the cover panel inserted in the cover slot of each cover component of the first pair and in the cover slot of each cover component of the second pair. FIG. 4 shows the cover 12 being inserted in a slot 70 running perpendicular to the view shown in FIG. 4, along a top edge of the component 18 into which the cover 12 is being inserted. The top edge 50 is the same as previously indicated in FIG. 1. The four dowel rods are inserted in the offset dowel channels shown in FIG. 3 to unite the cover components with another when assembled into the box-shaped heat barrier structure as shown.

The assembled cover device embodiment as shown thereby forms a three-dimensional heat barrier structure in a box-shaped configuration with a closed top defined by the cover panel 12 and an open bottom as shown facing the viewer in FIG. 2 (across from the cover) in the box-shaped heat barrier structure. The device is thereby capable of placement over a scuttle hole, attic access opening, louver opening, or an opening in a wall or floor.

As mentioned, the components are capable of being stacked together e.g. in a tight package to form a compact shipping unit, such that one or more such units are capable of being economically transported and/or stored. Once the package is received by the purchaser, it is disassembled and may be very quickly assembled. If the user has for instance an attic scuttle through which heat is being wastefully transferred from the warm house interior to the cold attic, he may quickly assemble the cover, place the assembled cover on the attic floor to cover the scuttle hole and thereby immediately provide an inexpensive and very effective heat barrier.

Figure 5:
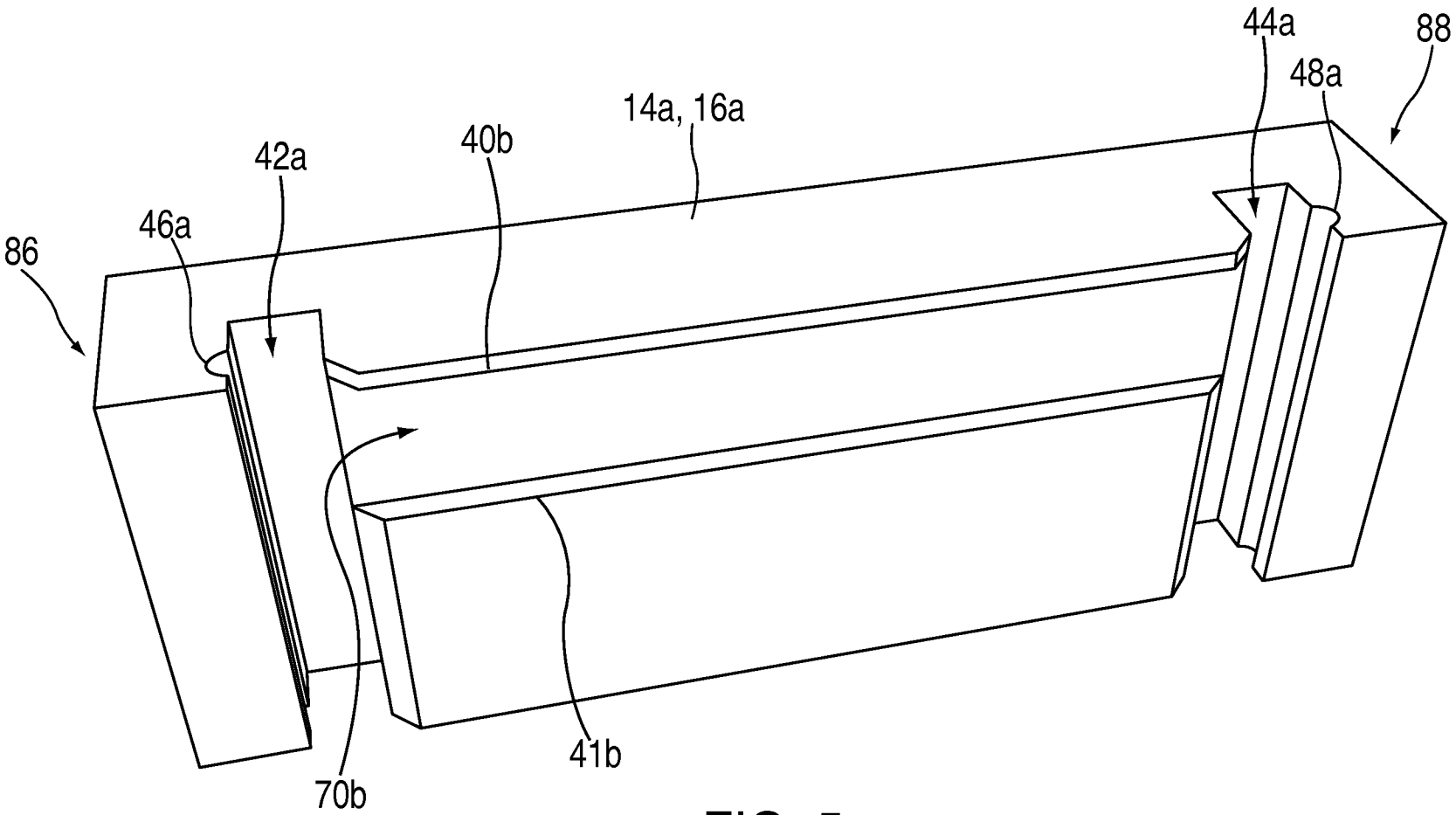
FIG. 5 shows an embodiment of a heat insulation component similar to the component of FIG. 1.
Figure 6:
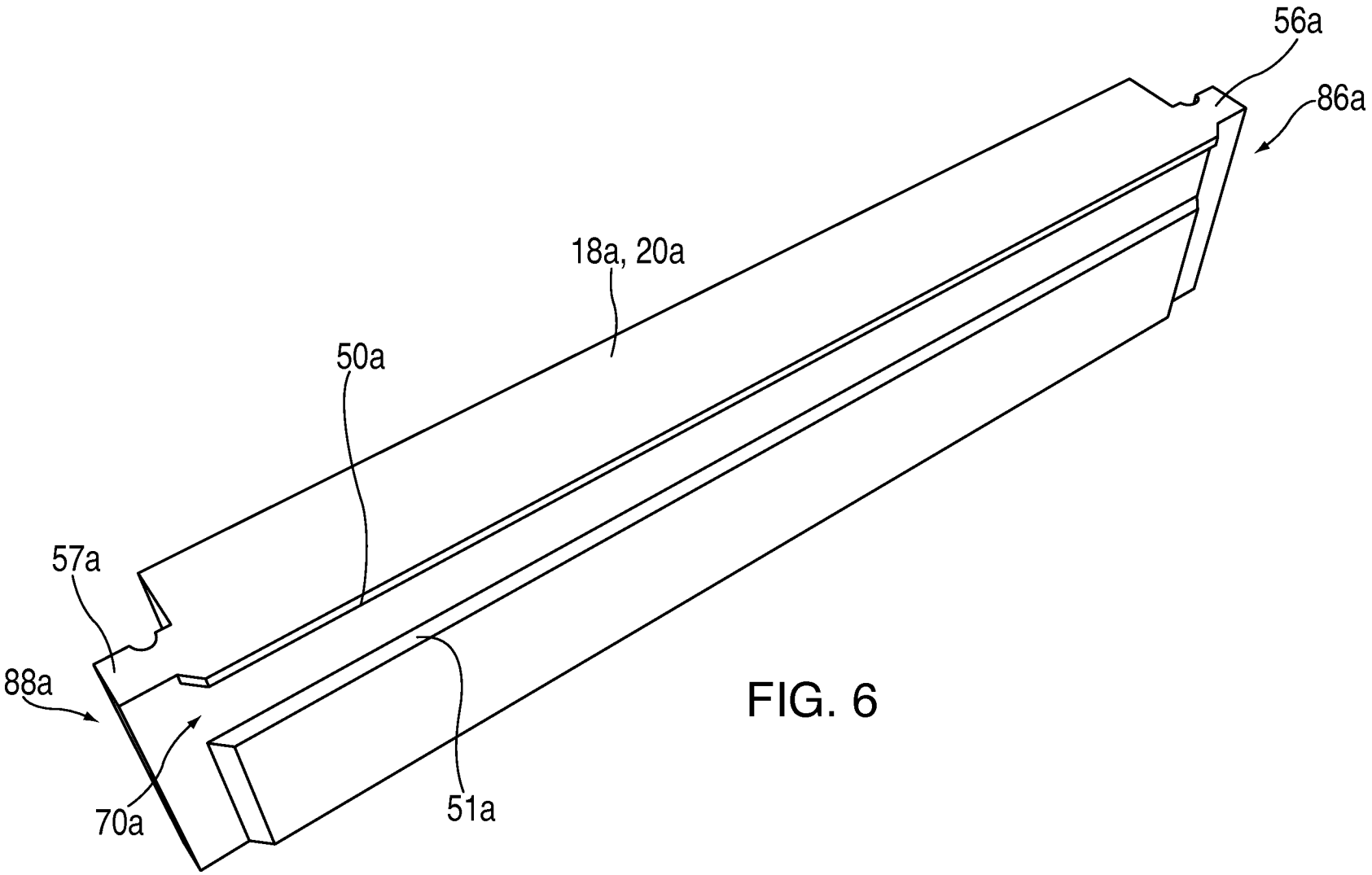
FIG. 6 shows a groove that has interior walls that are formed to mate with a rectangular tongue at an end of a component inserted therein.

An embodiment of a heat insulation component 14*a*, similar to the component 14 of FIG. 1, is shown in FIG. 5. It has a rectangular flat panel shape with two parallel rectangular grooves 42*a*, 44*a* at opposite ends 86, 88. The groove 42*a* has interior walls that are formed to mate with a rectangular tongue 56*a* as shown in FIG. 6 at an end 86*a* of a component 18*a* inserted therein. The component 18*a* is similar to the component 18 of FIGS. 1 and 2. A second component 20*a*, identical to the component 18*a*, has a tongue 57*a* at an end 88*a* thereof formed to mate with interior walls of the groove 44*a* of the component 14*a* of FIG. 5. A slot 70*a* with rectangular inner walls, similar to the slot 70 of FIG. 4 for receiving the cover 12, is shown in FIG. 6 bounded by a top edge 50*a* and a bottom edge 51*a*. A similar slot 70*b* is shown in the component 14*a*, 16*a* of FIG. 5 bounded by edges 40*b*, 41*b*. As described in further detail below, the component 16*a* is set up so as to be opposite to component 14*a* when assembling the cover and the components 18*a* and 20*a* of FIG. 6 serve the same role as just described for component 18*a* except in a mirror image way for component 16*a*.

Figure 7:
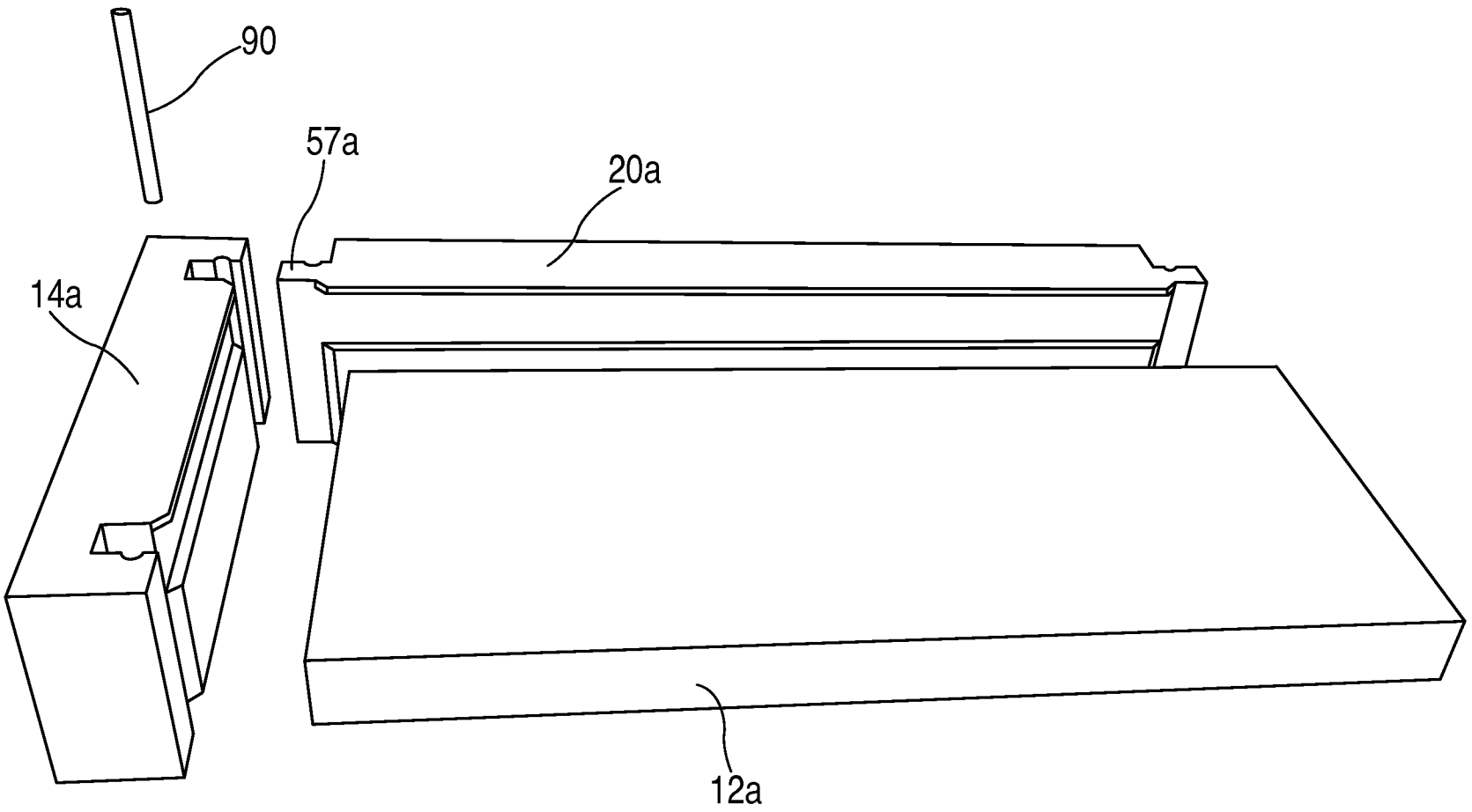
FIG. 7 shows some of the components of a kit according to the present invention laid out for assembly.

FIG. 7 shows some of the components of a kit according to the present invention laid out for assembly. The component 14*a* is shown on the left with the component 20*a* lined up perpendicular thereto with its tongue 57*a* aligned for insertion in the groove 44*a*. Cover 12*a* is shown ready for insertion in the slot 70*b* of component 14*a* and the slot 70*a* of component 20*a*. A dowel 90 in this embodiment shown as being a hollow cylinder is shown ready to be inserted in the dowel channel formed as shown in FIG. 3 by the insertion of the tongue 57*a* in the groove 44*a*.

Figure 8:
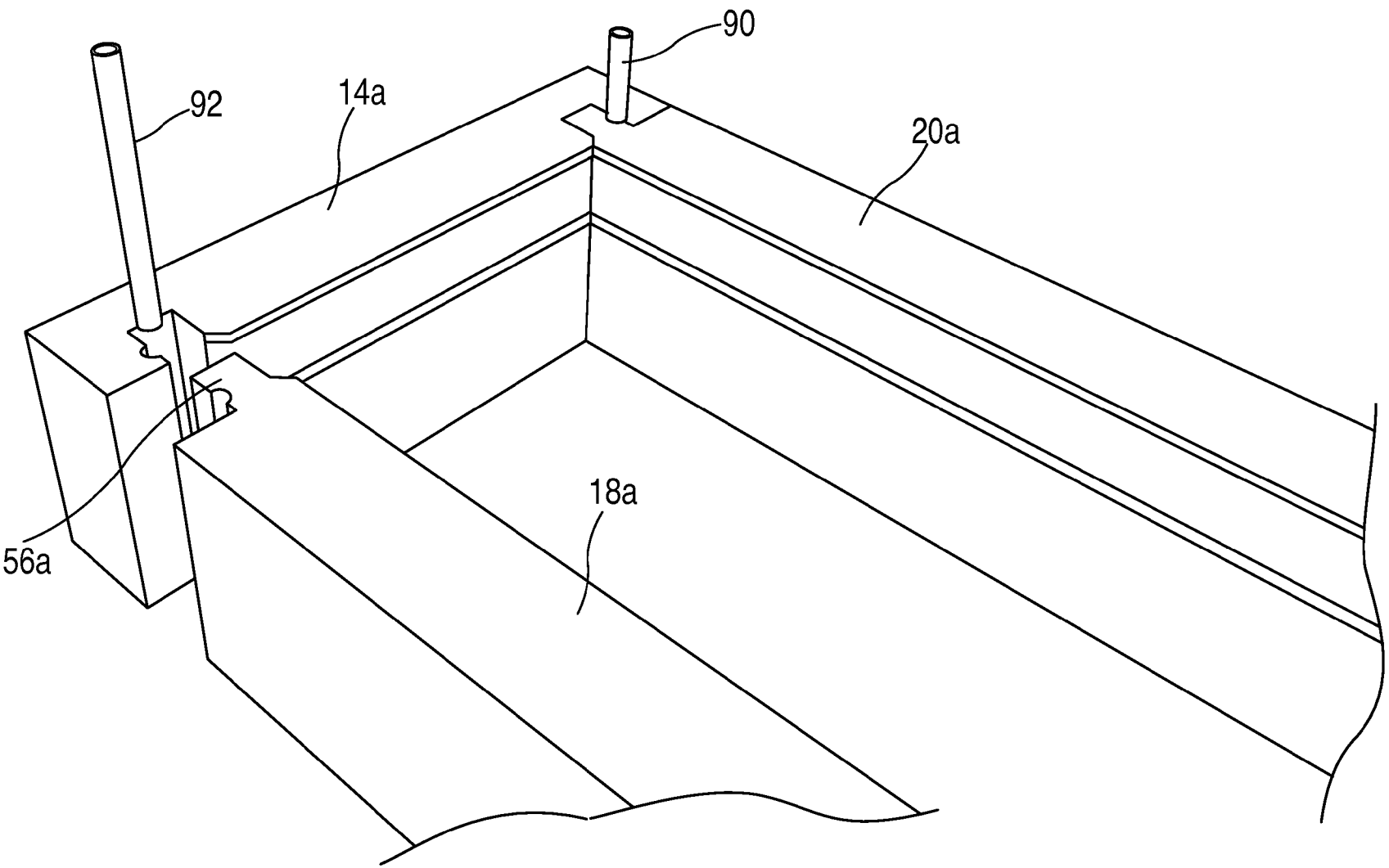
FIG. 8 shows a component joined to another component with a dowel almost fully inserted in a dowel channel so as to close a gap such as shown in FIG. 3 so as to form an airtight seal at the corner shown.

FIG. 8 shows the component 20*a* joined to the component 14*a* with the dowel 90 almost fully inserted in the dowel channel so as to close the gap 30 of FIG. 3 and form the airtight seal at the corner shown. The tongue 56*a* of the component 18*a* is shown approaching insertion in the groove 42*a* of the component 14*a* with another dowel 92 shown ready for insertion in the dowel channel once it is formed by matching the dowel channel halves in the tongue and groove as in FIG. 3.

Figure 9:
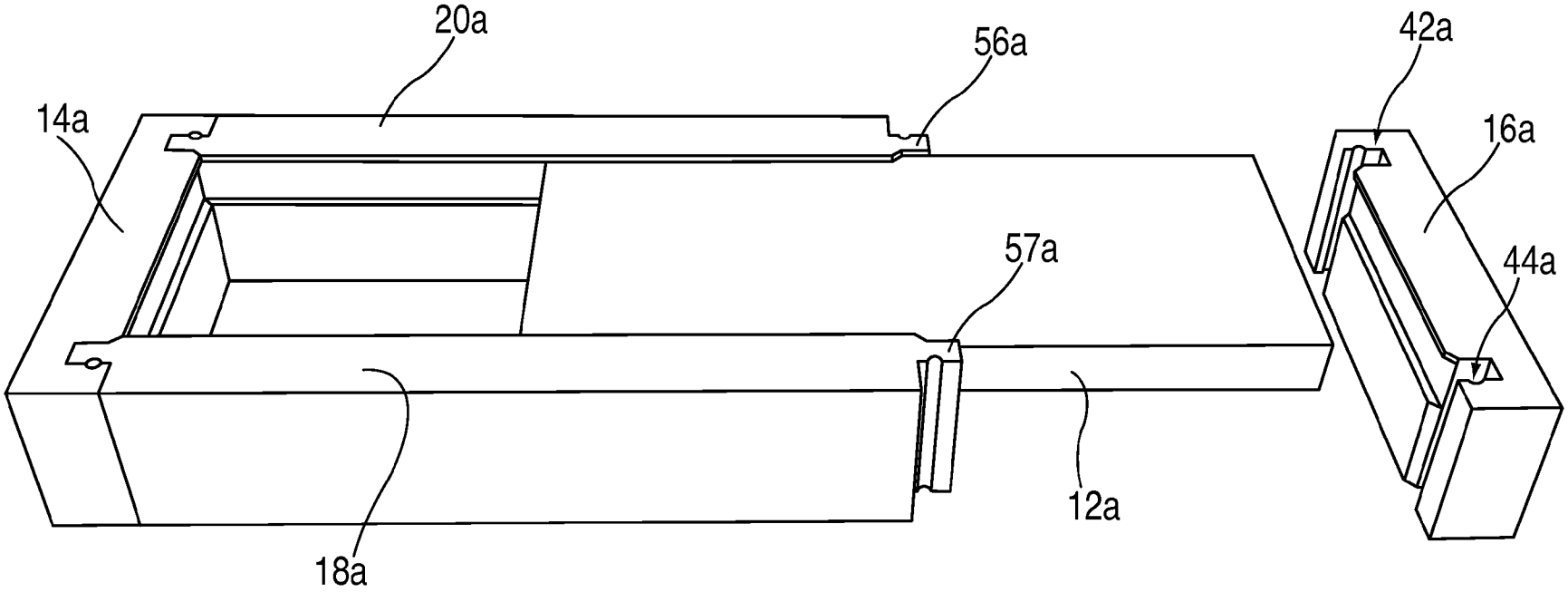
FIG. 9 shows the cover being slid into the opposite slots of the side components toward a similar slot in an end component.

FIG. 9 shows the cover 12*a* being slid into the opposite slots 70*a* of the side components 18*a*, 20*a* toward the similar slot 70*b* in component 14*a*. Once the cover 12*a* is seated in the slot 70*b* in component 14*a*, component 16*a* is joined to the assembly by having the remaining tongues 56*a*, 57*a* of components 20*a*, 18*a* inserted in the grooves 42*a*, 44*a* of component 16*a*. Two more dowels (not shown) are then inserted in the dowel channels formed by the insertion of the tongues in the grooves.

Figure 10:
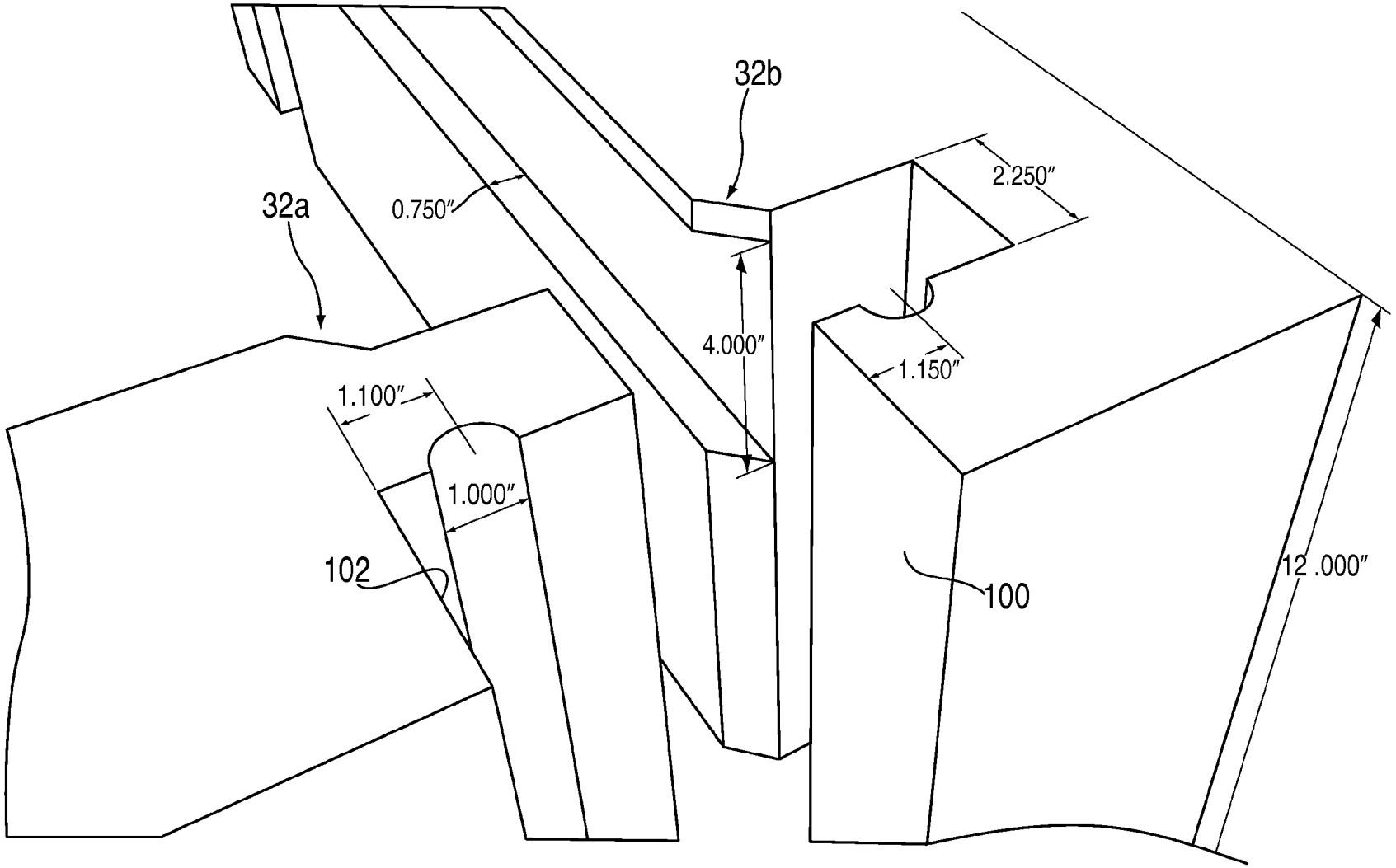
FIG. 10 shows a corner embodiment in better detail with some variation from that shown previously (different dimensions, different tongue and groove design, and different orientation of dowel channel from those shown in FIGS. 1 and 2).

FIG. 10 shows a corner embodiment in better detail with some variation from that shown previously (different dimensions, different tongue and groove design, and different orientation of dowel channel from those shown in FIGS. 1 and 2). A corner of a cover device is shown in the act of assembly with a tongue aligned into position for insertion in a groove. An angled surface 32*a* of the tongue will lie against an angled surface 32*b* of the groove once the tongue is inserted in the groove, in a similar but slightly different way than that already shown by reference numeral 32 in FIG. 3. The height of the cover device is shown in this embodiment is 12 inches and the dowel cylinder or rod will have the same length with a diameter of 1 inch to fit in the dowel channel which is also 1 inch in diameter. In the embodiment shown, the groove and tongue are each 2.25 inches wide and the cover slot is shown being 4 inches wide with a depth of three-quarters of an inch. The dimensions of the tongue and groove are chosen in order to ensure a gap similar to the gap 30 of FIG. 3 and an offset also discussed above in connection with FIG. 3, so that upon initial insertion, the dowel channel halves will be offset slightly. The gap will be closed and the offset removed upon insertion of a dowel and the seal will be formed at the corner by virtue of surfaces such as surfaces 32*a* and 32*b* being subjected to constant pressure by the dowel holding the two channel halves together, without the offset, thereby exerting compression forces on the mating surfaces 32*a*, 32*b* as well as the other surrounding mating surfaces including surfaces 100, 102.

While a particular feature of the invention may have been described above with respect to only one or some of the embodiments illustrated, such a feature may also be combined with one or more other features of the other embodiments, in any way such as may be desirable or advantageous for any given application of the invention. While there have been shown and described and pointed out fundamental novel features of the invention as applied to preferred embodiments thereof, it will be understood that various omissions and substitutions and changes in the form and details of the devices and methods described may be made by those skilled in the art without departing from the spirit and scope of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. Furthermore, any means-plus-function clauses now or later introduced are intended to cover the structures described herein as performing the recited function and not only structural equivalents, but also equivalent structures.

The invention claimed is:

1. A cover device kit, comprising: a plurality of heat insulation components comprising a polymer insulating material capable of being transported in a disassembled state and then assembled into a box-shaped heat barrier structure having six sides including an opening on an open side, said box-shaped heat barrier structure for covering an opening in a floor or wall of a building with said opening on said open side surrounding said opening in said floor or wall and resting on said floor or against said wall, wherein four of said plurality of heat insulation components each comprises two complimentary connections for uniting with mating polymer surfaces of said polymer insulating material in a polymer insulating material joint with two corresponding complimentary connections of two corresponding adjacent heat insulation components of said plurality of heat insulation components, wherein each polymer insulating material joint comprises a whole dowel channel made of two half dowel channels with a dowel rod inserted in the whole dowel channel when assembled into four side walls of said box-shaped heat barrier structure, and wherein a fifth heat insulation component of said plurality of heat insulation components unites with said four side walls of said box-shaped structure opposite said opening on said open side.

2. The cover device kit of claim 1, wherein said two half dowel channels comprise one half dowel channel in a mating polymer surface that is offset from another complementary half dowel channel in a corresponding complimentary polymer mating surface of the adjacent heat insulation component so that when a dowel is inserted to make the polymer insulating material joint, the polymer mating surface and the complimentary polymer mating surface are compressed together to remove the offset and form a resultant airtight seam.

3. The cover device kit of claim 1, wherein said heat insulation components are for blocking heat transfer through said opening in said floor of said building from a first area in said building to a second area in said building that is cooler than said first area or are for blocking heat transfer through said opening in said wall of said building from a first area inside said building to a second area inside or outside said building that is cooler than said first area.

4. The cover device kit of claim 1, wherein said plurality of heat insulation components comprises a plurality of polymer panels and wherein said fifth heat insulation component comprises a cover panel comprising polymer insulating material that unites with said four side walls comprising four panels comprising polymer insulating material by insertion in grooves cut in the polymer insulating material of said four panels.

5. The cover device kit of claim 1, wherein said polymer insulating material joint is independently selected from the group consisting of a tongue and groove joint, a step joint, a dovetail joint, a box joint, a mortise and tenon joint, a dado joint, a dowel butt joint, a butt joint, a lap joint, and a halving joint.

6. The cover device kit of claim 1, wherein said polymer insulating material joint is a tongue and groove joint.

7. The cover device kit of claim 1, wherein said plurality of heat insulation components are flat panels that are packaged for transport and/or storage with the flat panels sized for being stacked in a stack of flat panel layers so as to provide for flat pack packaging.

8. The cover device kit of claim 1, wherein each heat insulation component of said plurality of heat insulation components consists of said polymer insulating material.

9. The cover device kit of claim 1, wherein said plurality of heat insulation components of said kit comprises:

a first pair of cover components, wherein each cover component of said first pair of cover components comprises a four-sided groove-type panel including a cover groove running along one edge of a first side of said four-sided groove-type panel and two slots in said first side running along opposite edges of said four-sided groove-type panel perpendicular to said cover groove, each slot including a parallel half dowel channel in a wall of the slot;

a second pair of cover components, wherein each cover component of said second pair of cover components comprises a four-sided tongue-type panel including a cover groove running along one edge of a first side and two tongues running along opposite edges of said four-sided tongue-type panel perpendicular to said cover groove, each tongue including a parallel half dowel channel in a wall of the tongue;

a cover panel; and four dowel rods, wherein said cover device kit is capable of being transported in a disassembled state and then assembled when said first pair of cover components are united with said second pair of cover components so that each cover component of each pair is assembled opposite to the other cover component of the pair, by insertion of each tongue of said two tongues of each cover component of said second pair of cover components in a corresponding slot of said two slots of a cover component of said first pair of cover components, and with said cover panel inserted in said cover groove of each cover component of said first pair and in said cover groove of each cover component of said second pair, and wherein said four dowel rods are inserted in said whole dowel channel made of said parallel half dowel channels in each slot to form said at least one polymer insulating material joint for uniting each of said cover components with another cover component when assembled into said box-shaped heat barrier structure.

10. The cover device kit of claim 9, wherein said box-shaped heat barrier structure comprises a three-dimensional heat barrier structure having a box-shaped configuration with a closed top defined by said cover panel and an open bottom in said box-shaped heat barrier structure and said box-shaped heat barrier structure is thereby capable of placement over a scuttle hole, attic access opening, louver opening, or an opening in a wall or floor.

11. The cover device of claim 9, wherein said first pair of cover components and said second pair of cover components are capable of being stacked together to form a flat packed unit.

12. A cover device comprising:

a first pair of cover components, wherein each cover component of said first pair of cover components comprises a four-sided groove-type panel including a cover groove running along and below a top edge of a first side of said four-sided groove-type panel and two side grooves running along opposite edges of said first side of said four-sided groove-type panel perpendicular to said cover groove, each side groove including a parallel dowel channel half in a wall of the side groove;

a second pair of cover components, wherein each cover component of said second pair of cover components comprises a four-sided tongue-type panel including a cover groove running along and below a top edge of a first side of said four-sided tongue-type panel and two tongues in said first side running along opposite edges of said four-sided tongue-type panel perpendicular to said cover groove, each tongue including a parallel dowel channel half in a wall of the tongue that is complementary to a parallel dowel channel half in a mating side groove of a corresponding cover component of the first pair of cover components;

a cover panel; and four dowel rods, wherein said cover device is capable of being transported in a disassembled state and then assembled when said first pair of cover components are united with said second pair of cover components so that each cover component of each pair is assembled with the first side opposite to the first side of the other cover component of that pair, by insertion of each tongue of said two tongues of each cover component of said second pair of cover components in a corresponding side groove of said two side grooves of a cover component of said first pair of cover components, and with said cover panel inserted and secured within said cover groove of each cover component of said first pair and within said cover groove of each cover component of said second pair, and wherein said four dowel rods are each inserted in a whole dowel channel formed by said parallel dowel channel half in each side groove and a complimentary dowel channel half in a wall of an inserted tongue of the corresponding cover component to form a complimentary connection for uniting each of said cover components with two other cover components by exerting compressive forces on mating surfaces of said first pair of cover components and said second pair of cover components when assembled into said cover device.

13. The cover device of claim 12, wherein each side groove comprises said dowel channel half in said wall of the side groove such that it is offset from said complementary dowel channel half in a wall of an inserted tongue of the corresponding cover component so that when a dowel rod is inserted to make said at least one complimentary connection, the wall of the tongue and the complimentary wall of the groove are compressed together by the act of insertion to remove the offset and form a resultant airtight seam.

14. The cover device of claim 12, wherein when said cover device is assembled, the cover device comprises a cover device in a box-shaped configuration capable of placement over a scuttle hole, attic access opening, louver opening, or an opening in a wall or floor.

15. The cover device of claim 12, wherein said first pair of cover components and said second pair of cover components are capable of being stacked together to form a flat packed unit.

16. The cover device of claim 12, wherein said first pair of cover components and said second pair of cover components are flat panels that are packaged for transport and/or storage with the flat panels sized for being stacked in a stack of flat panel layers so as to provide for flat pack packaging.

* * * * *